US008376143B2

(12) United States Patent
Lane et al.

(10) Patent No.: US 8,376,143 B2
(45) Date of Patent: Feb. 19, 2013

(54) SCREEN PANEL CENTER RETAINER SYSTEM

(75) Inventors: Tracy Leonard Lane, Princeton, WV (US); Frank J. Bacho, Princeton, WV (US)

(73) Assignee: Conn-Weld Industries, Inc., Princeton, WV (US)

( * ) Notice: Subject to any disclaimer, the term of this patent is extended or adjusted under 35 U.S.C. 154(b) by 0 days.

(21) Appl. No.: 13/070,601

(22) Filed: Mar. 24, 2011

(65) Prior Publication Data

US 2011/0180461 A1 Jul. 28, 2011

Related U.S. Application Data

(63) Continuation-in-part of application No. 12/216,834, filed on Jul. 11, 2008, now Pat. No. 7,946,428.

(51) Int. Cl.
*B07B 1/49* (2006.01)

(52) U.S. Cl. ..... 209/405; 209/395; 209/399; 209/403

(58) Field of Classification Search ..... 209/395, 209/399, 403, 405
See application file for complete search history.

(56) References Cited

U.S. PATENT DOCUMENTS

| | | | | |
|---|---|---|---|---|
| 4,840,728 | A | 6/1989 | Connolly et al. | |
| 5,112,475 | A | 5/1992 | Henry, Jr. | |
| 5,277,319 | A * | 1/1994 | Henry, Jr. | 209/399 |
| 5,398,817 | A * | 3/1995 | Connolly et al. | 209/399 |
| 5,755,334 | A * | 5/1998 | Wojcik et al. | 209/399 |
| 5,829,599 | A * | 11/1998 | Woodgate | 209/399 |
| 6,206,200 | B1 * | 3/2001 | Gilles et al. | 209/399 |
| 6,830,155 | B2 * | 12/2004 | Taylor et al. | 209/680 |
| 6,964,341 | B2 * | 11/2005 | Bacho et al. | 209/405 |
| 7,717,269 | B2 | 5/2010 | Bacho et al. | |
| 7,946,428 | B1 | 5/2011 | Lane et al. | |
| 2002/0195377 | A1 * | 12/2002 | Trench et al. | 209/365.1 |

* cited by examiner

*Primary Examiner* — Terrell Matthews
(74) *Attorney, Agent, or Firm* — Mattingly & Malur, P.C.

(57) ABSTRACT

A screen panel center retainer system for a vibrating separatory machine utilizes a center retainer that is provided with a retainer base which is adapted to be secured to screen stringer rails of a vibrating separatory machine. A pair of retainer channel legs form an upper portion of the center retainer and have screen panel edge receiving slots. A locking strip, having a wedging tongue, is used in conjunction with the center retainer. The wedging tongue is insertable into the channel on the center retainer which is defined by the two retainer channel legs. Flow control dams and cross dam retainers are used in conjunction with, and in addition to the center retainers and locking strips. The cross dam retainers are provided with locking strip end receiving pockets, to compensate for changes in the length of the locking strips. The screen panel center retainer system is configured to provide a functional, universal installation of screen panels on vibrating separating machines.

7 Claims, 12 Drawing Sheets

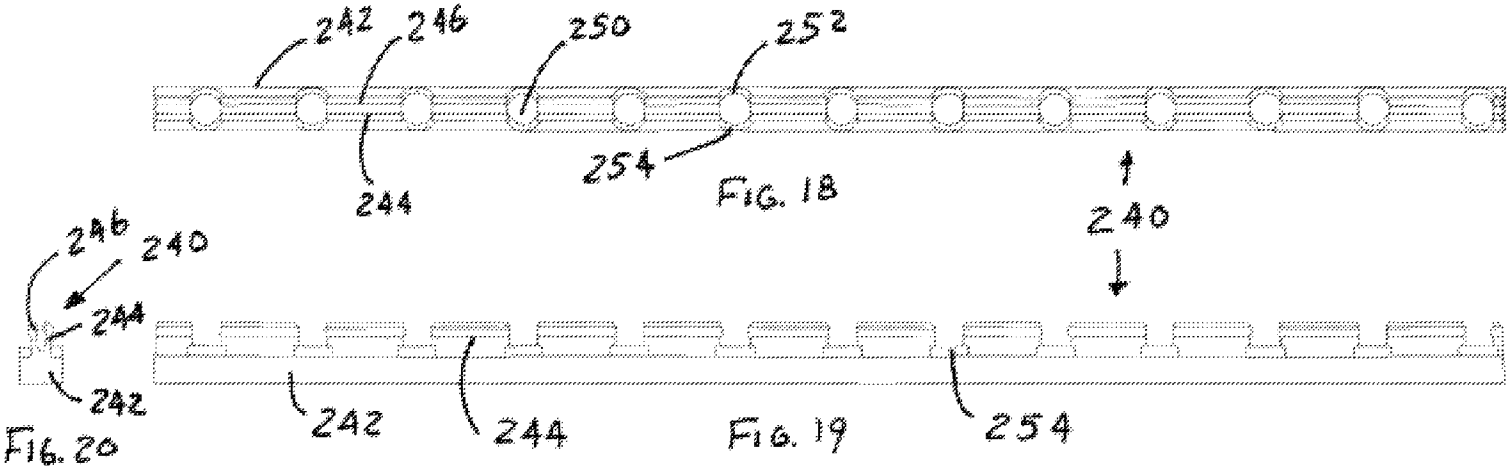
FIG. 18
FIG. 19
FIG. 20
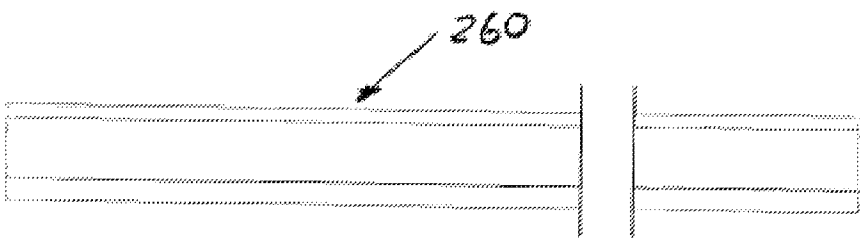
FIG. 21
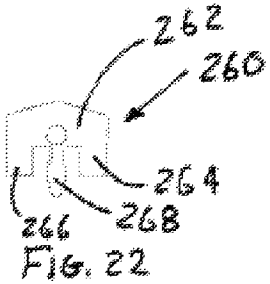
FIG. 22

SCREEN PANEL CENTER RETAINER SYSTEM

CROSS-REFERENCE TO RELATED APPLICATIONS

This application is a continuation-in-part of prior application No. 12/216,834, filed Jul. 11, 2008, now U.S. Pat. No. 7,946,428, issued May 24, 2011, the disclosures of which are expressly incorporated herein by reference.

FIELD OF THE INVENTION

The present invention is directed generally to a screen panel center retainer system. More particularly, the present invention is directed to a center retainer system for use in retaining screen panels on a vibrating separatory device. Most specifically, the present invention is directed to a screen panel retainer system that is usable to releasably mount screen panels on screen stringer rails of vibrating separatory machines. A center retainer is secured to each of the screen stringer rails of a generally conventional vibrating separatory machine. The center retainer is attachable to the screen stringer rails using expansion sleeves and expansion pins, or bolts. A lock strip has a wedge tongue that is configured to be receivable in a cooperating central channel of the center retainer. Insertion of the wedge tongue into the center retainer channel acts to deflect channel walls apart and into engagement with screen tie rods and spacer bars on screen panels which are thus held in place on the center retainer. A plurality of cross dams and dam retainers may be provided. The dam retainers are configured to receive the longitudinal ends of the lock strips and to compensate for thermally caused dimensional changes of those lock stripes.

BACKGROUND OF THE INVENTION

Vibrating and other separatory screen assemblies are generally known in the art and are very useful in accomplishing the separation of materials, on the basis of the size of the materials to be separated. A slurry of liquid and entrained solids can be caused to run or to flow across an upper surface of a screen panel assembly. Particles of at least a certain size will not pass through apertures in the screen panels and will thus be separated out of the slurry. The screen panel assembly is caused to vibrate by a suitable vibratory drive, with this vibratory motion being beneficial in facilitating the proper separation of the slurry which is directed onto the screen panel.

One such vibrating separatory screen panel assembly is shown in U.S. Pat. Nos. 5,112,475 and 5,277,319, both to Henry, and both assigned to Conn-Weld Industries, the assignee of the present application. In those two patents, there is disclosed a screen panel mounting system for a vibrating screen assembly. There is also disclosed a screen panel which is securable in the vibrating screen assembly by using the panel mountings system. A plurality of screen panels are secured to a panel deck of a frame portion of a vibrating screen assembly. A plurality of elongated hold downs or center retainers, which are made of a resilient elastomeric material, such as polyurethane, are provided with integral spaced anchoring pins along their bottom surface. Those integral, spaced anchoring pins are receivable in apertures in an anchor member. Once the hold down members or center retainers have been secured to the anchor member, which is, in turn, attached to spaced cross members or tubes of the frame of the vibratory separator, the screen panels are placed atop the panel deck with their side edges in contact with the center retainers. Elongated key members are inserted into upwardly facing slots in the center retainers to spread wing portions of the retainers laterally outwardly. This spreading of the wings of the center retainers causes the wings to grip the side edges of the screen panels so that these panels are secured in the vibrating screen assembly.

The panel mounting system, which is disclosed in the two above-referenced Henry patents utilizes screen panels and cooperating anchor members which must be bolted, welded or otherwise secured to cross members of the panel deck of the vibrating screen assembly. An owner of a prior art vibrating screen apparatus, which is not provide with the appropriate anchor members disclosed in the prior Henry patents, must make substantial revisions and modifications to his vibrating screen assembly if he is to be able to enjoy the advantages of the Conn-Weld Industries panel mounting system.

A center retainer assembly for a panel mounting system is disclosed in U.S. Pat. No. 5,398,817 to Connolly et al, which is also assigned to Conn-Weld Industries. The center retainer assembly described in the '817 patent utilizes an elongated bolting bar which is encased in a resilient material and which includes an elongated center retainer. The center retainer assembly of this patent is placed into an upwardly facing retainer channel and is secured to the retainer channel by placement of the bolts carried by the bolting bar through holes in the retainer channel. The retainer channel is, in turn, secured to mounting plates that are attached to a cross tube or to a cross bar of a vibrating screen assembly.

A more recent screen panel retainer system is described in U.S. Pat. No. 6,964.341 to Bacho, et al. That patent is also assigned to Conn-Weld Industries, the assignee of the subject patent application. In that system, the screen panels are held in place by screen panel edge strips which have pockets on their under surfaces. Those pockets are cooperatively shaped to receive a plurality of ears that are situated on upper surfaces of retainer bars. Those retainer bars are connected to the underlying screen stringer rails.

A snap lock separating panel and retainer system is disclosed in U.S. patent application Ser. No. 11/798,537; filed May 15,2007 in the name of the inventors of the subject patent application, now U.S. Pat. No. 7,717,869, issued May 18,2010, and also assigned to Conn-Weld Industries, Inc. In that application there is disclosed a snap lock separating panel retainer system as well as a separating panel which is usable with the retainer system. Elongated locking strips are used to engage locking profiles on the separating screen panels. Those locking strips utilize under cut receptacles to receive enlarged heads of retainer pins that are formed integrally with center retainer strips. Those center retainer strips are, in turn, secured to the screen stringer rails that are typically provided in vibrating separatory machines. The locking strips are snap locked onto the center retainer by the engagement of the enlarged heads of the retainer pins in the cooperatively shaped undercut receptacles in the locking strips.

The various screen panel retainer systems, as described and depicted in the several Conn-Weld Industries patents and applications discussed above, have all enjoyed some degree of success in the industry. However, each has its individual limitations which have made each system less than suitable for use in all equipment, regardless of manufacturer and configuration. Several of the earlier systems required modification or reworking of the industry standard screen stringer rails. Others, such as the system described in the Bacho et al U.S. Pat. No. 6,964,341 have been found somewhat difficult to use and have required the provision of screen panel edge strips that have had to be field-installed on the replacement screen panels. Adjacent screen panels have sometimes required the use of cooperating and abutting screen panel edge strips. The abutment and alignment of these screen panel edge strips has been somewhat difficult to obtain in the field. This has increased the time that is required to both initially install the prior systems and to then replace worn screen panels with replacement screen panels. When a machine, which is operating in an industrial setting, must be taken out of service for repair or replacement of essential elements, that is a loss of that machine's production capacity. Such losses need to be kept at a minimum.

Several of the prior screen panel securement arrangements, in addition to their requirement of special screen panel edge strips, have required numerous parts and have been expensive to make and install. As discussed above, when a production machine is taken out of service, money is lost. It is this imperative that the screen panel retainer system be relatively simple, having a limited number of components, that is be quick and easy in its installation, and universal in its ability to adapt to all of the various vibrating separating machines that are used in the industry. Those various machines typically utilize screen stringer rails that are secured atop cross tubes which are frame components of the vibrating separatory machines. The screen stringer rails are typically 2"×2" hollow steel tubes and are provided with mounting holes spaced along an upper surface of each such screen stringer rail at a spacing distance of 4". This industry standard configuration must serve as the basis for the configuration of the screen center panel retainer system.

A vibrating separating machine uses an array of screen panels to separate solid materials from a slurry. The screen panels are situated in an array that typically utilizes a plurality of screens abutting each other, or adjacent to each other both in a direction of material flow and also in a direction the is traverse to the material flow direction. It is the exposed surface area of these screen panels which accomplishes the material separation. The greater the amount of exposed screen surface, the greater capacity for material separation the machine will have. In the prior systems, the retainer structures have tended to cover over substantial portions of the sides or edges of adjacent ones of the screen panels. While that reduction in available screen surface area may amount to only 5% of the total screen surface area, that is still 5% of the total screen surface area which is no longer available for accomplishing the machine's primary objective of separation of solids from a slurry. Any increase in open screen area will improve the operating characteristics of the vibrating separatory machine that uses the screen panel center retainer system of the present invention.

Many of the prior screen panels utilize cross dams and dam retainers. The ends of the lock strips in prior systems have abutted the ends of the dam retainers. Temperature changes may cause the length of the lock strips to change. This will either lead to an interference between the ends of the lock strips and the cooperating pieces of the dam retainers or will form a gap that may let particles pass through.

It will thus be understood that a need exists for a screen panel retainer system which overcomes the limitations of the prior systems, which uses a minimum number of panels, which is easily installed and operable, which is adaptable to various screen stringer rails and which provides an increase in open screen area. The screen panel center retainer system, in accordance with the present invention, overcomes the limitations of prior art and is a substantial advantage over the presently available systems,

SUMMARY OF THE INVENTION

It is an object of the present invention to provide a screen panel center retainer system.

Another object of the present invention is to provide a screen panel center retainer system that uses a minimum number of components.

A further object of the present invention is to provide a screen panel center retainer system that is usable with a number of vibrating separatory machines.

Still another object of the present invention is to provide a screen panel center retainer system which does not require the modification of screen panels.

Yet a further object of the present invention is to provide a screen panel center retainer system which provides increased open screen area.

Even still another object of the present invention is to provide a screen panel center retainer system which is easy to use and is cost effective.

An even further object of the present invention is to provide a screen panel center retainer system that will facilitate its universal attachment to various screen stringer rails without change.

Yet still another object of the present invention is to provide a screen panel center retainer system that can accommodate thermally caused dimensional changes in the longitudinal lengths of the lock strips and specifically their cooperation with the dam retainers against whose ends they abut.

As will be described in the detailed description of the preferred embodiment, as is set forth subsequently and as is depicted in the accompanying drawings, the screen panel center retainer system in accordance with the present invention utilizes a center, retainer and a cooperating lock strip arrangement to secure screen panels to the screen stringer bars and to the sideboards of generally well known vibrating separatory machines. The center retainer is provided with a generally rectangular or square retainer base whose width is such that it is compatible with screen stringer rails of 2-inch widths. The center retainer can also be used with screen stringer rails that have a greater transverse upper surface width. A generally V-shaped screen panel edge retainer channel is formed as art upper part of each center retainer base. This channel has two channel legs that cooperate to define the generally V-shaped or U-shaped screen panel edge retainer portion of the center retainer.

A lock strip is provided with a wedge tongue that is dimensioned to fit into the channel of the screen panel edge retainer portion of the center retainer. The shape and size of the wedge tongue of the lock strip is selected, in conjunction with the size and configuration of the center retainer's screen edge, retainer so that the wedge tongue will wedge or deflect the two channel legs of the screen panel edge retainer laterally apart. Each screen edge retainer leg is provided with an outer surface that is configured to engage a screen panel. Each such screen panel is structured generally as described and depicted in-the prior Bacho et al, U.S. patent application Ser. No. 11/798,5,37, now U.S. Pat. No. 7,717,269, as noted above, the disclosure of which is specifically incorporated herein by reference.

Each center retainer is provided with a plurality of spaced through bores which extend from the center of the channel of the screen panel edge retainer portion of the center retainer and through the base of the center retainer. These holes or bores are spaced on 4-inch centers and are thus intended to cooperate with the typical array of holes on the screen stringer base of the majority of vibrating separatory machines. The center retainers are configured to be universally adapted to a variety of machine bases. Their center through bores may be provided with a circumferentially extending, raised ring or lip to prevent passage of the materials being separated.

Each center retainer can be attached to its associated underlying screen stringer rail by the use of cooperating expansion pin inserts, by the use of sleeves and expansion pins or by the use of spline bolts and associated nuts and washers. A combination of both expansion pins inserts and pins and of spline bolts can be used, if desired, to insure mat each center retainer is positively and permanently attached to the associated screen stringer rail. Depending on the configuration of the specific screen stringer rail and the preference of the owner of the vibrating separatory machine to which the system, in accordance with the present invention, is to be installed, either the expansion sleeves and pins, the spline bolts, or a combination of both can be used to secure the center retainer bars in place on the underlying screen stringer rails. Each center-retainer is configured to be universally attachable to the wide variety of machine decks that are in commercial use. The specific attachment method does not need to be determined prior to arrival at the end user's facility. The center retainer of the present invention is able to accommodate such different replacement conditions.

As is typical in vibrating separatory machines, the screen panel bed is divided into sections by a plurality of dams that are placed transversely to the direction of material flow, These dams act as impediments to the flow of the slurry to be separated along the surface of the screen device. They provide adequate time for the profile screen wires of the screen panels to accomplish their task. In the subject invention, these transverse dams are held in place by cross-dam retainers. These cross-dam retainers have the same wedge tongue as do the lock strips. They thus are also engageable with the screen panel edge retainer channels of adjacent of the center retainer strips, in the direction of material flow. These cross dam retainers are no wider than are the lock strips, whose widths are the same as the widths of the bases of the center retainers. The dam retainers can be configured so that they will be able to accommodate thermally induced length changes in the lock strips.

Each center retainer is, as discussed above, adapted to be attachable to a screen stringer rail that is only 2 inches wide. The provision of either expansion sleeves and expansion pins and/or spline bolts for use in the attachment of the center retainer to the screen stringer rails is a simple process that can be adapted/to virtually any screen stringer rail. The width of the center retainer is such that it does not extend laterally beyond the 2-inch width of the screen stringer rails. The lock strips have the same width The overall footprint of the combination of the center retainers and cooperating locking strips is thus less than that of prior devices. This results in an increase in the available screen panel area that can be used for slurry separation. The screen panel edge retainers of the center retainer overlie only the portion of the screen tie rods and space bars that are provided at the edges of the individual screen panels. This expands the maximum amount of each screen panel which is available for use, so that the capability of the vibrating separatory machine, equipped with the screen panel center retainer system of the present invention, will be maximized.

The screen panel center retainer system in accordance with the present invention/overcomes the limitations of the prior systems. As discussed above, it is usable, without virtually any modification, with the majority of generally known vibrating separating devices. It requires fewer parts and is thus less expensive than the prior systems which it is intended to replace. It is usable with screen panels that are presently commercially available and thus does not require new or different screen panel structures. It increases the open screen area of the separating machinery which results, in improved capacity with the same overall amount of bed area. It substantially reduces gaps through which unseparated slurries of material can pass. For all of these reasons, the screen panel center retainer system, in accordance with the present invention, is a substantial advance in the art and overcomes the limitations of the prior systems.

BRIEF DESCRIPTION OF THE DRAWINGS

While the novel features of the screen panel center retainer system in accordance with the present invention are set forth with particularity in the appended claims, a full and complete understanding of the invention may be had by referring to the detailed description of the preferred embodiment which is presented subsequently, and as illustrated in the accompany drawings, in which:

FIG. 18 is a top plan view of a second embodiment of a center retainer in accordance with the present invention;

FIG. 19 is a side elevation view of the center retainer of FIG. 18:

FIG. 20 is an end view of the center retainer of FIG. 18;

FIG. 21 is a side elevation view of a second preferred embodiment of a lock strip in accordance with the present invention; and FIG. 22 is an end view of the lock strip of FIG. 21.

DESCRIPTION OF THE PREFERRED EMBODIMENT

Figure 1:
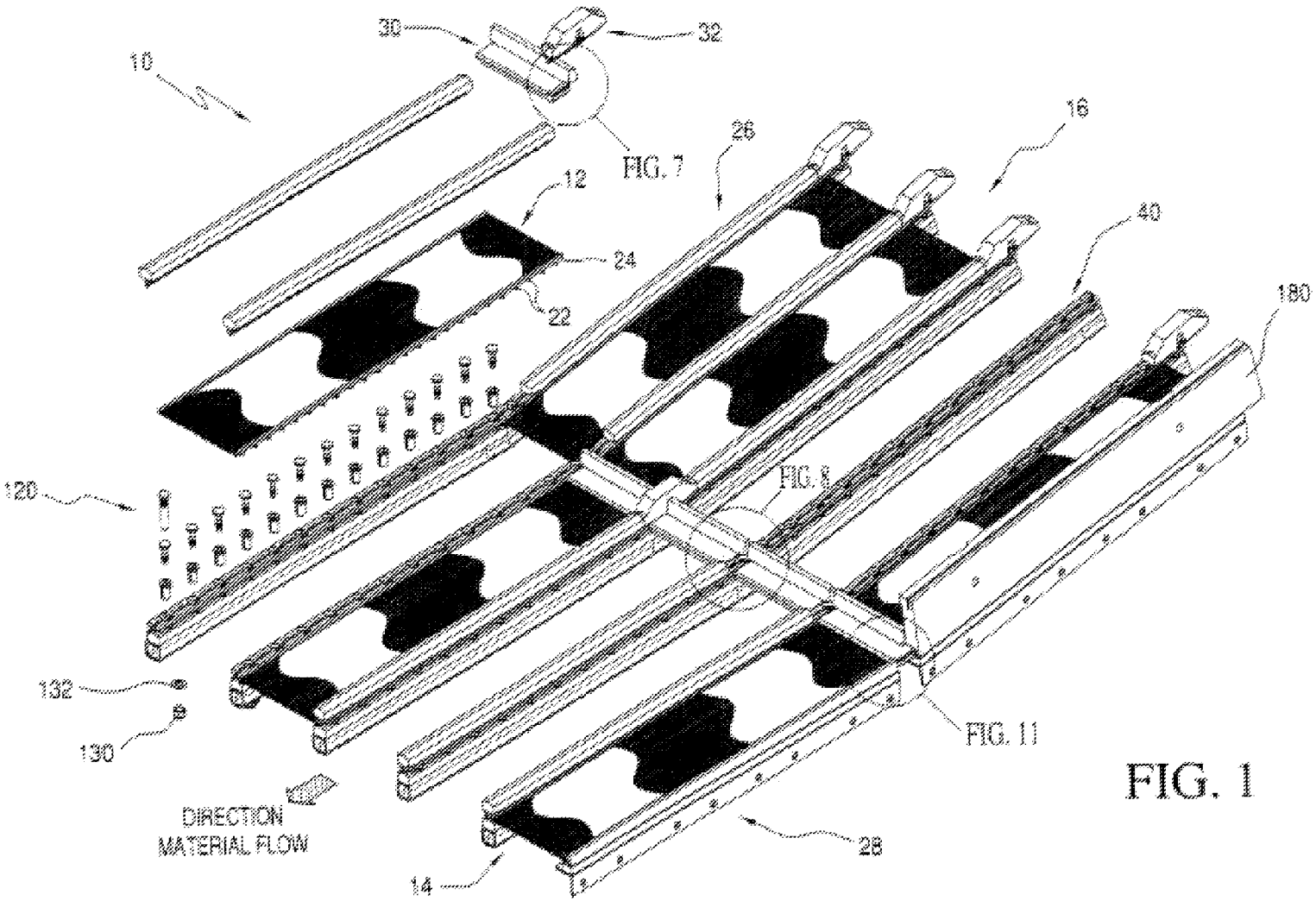
FIG. 1 is a perspective view of a portion of a vibrating separatory machine and showing, in exploded perspective, the several components of the screen panel center retainer system in accordance with the present invention.

Referring initially to FIG. 1, there may be seen, generally at 10, a first preferred embodiment of a screen panel center retainer system in accordance with the present invention. Screen panel center retainer system 10, as depicted in FIG. 1, is usable to secure a plurality of screen panels, each identified generally at 12, in place on screen stringer rails, generally at 14 of a vibrating separatory machine, generally at 16. It is to be understood that the vibrating separatory machine, depicted generally at 16 in FIG. 1 is not, a complete depiction of such a machine. Vibrating separatory machines are generally well-known in the art and themselves do not form a part of the present invention. The assignee of this patent application Conn-Weld Industries of Princeton, W. Va., is the manufacturer of such vibrating separatory equipment. However, there are also other manufacturers of generally similar equipment. Only as much of a Conn-Weld Industries vibrating separatory machine, as is required to provide a full and complete understanding of the structure and features of the present invention, is depicted and described in the subject patent application. Further information regarding vibrating separatory machines in general may be obtained at the website www.conn-weld-.com of Conn-Weld Industries.

Figure 4:
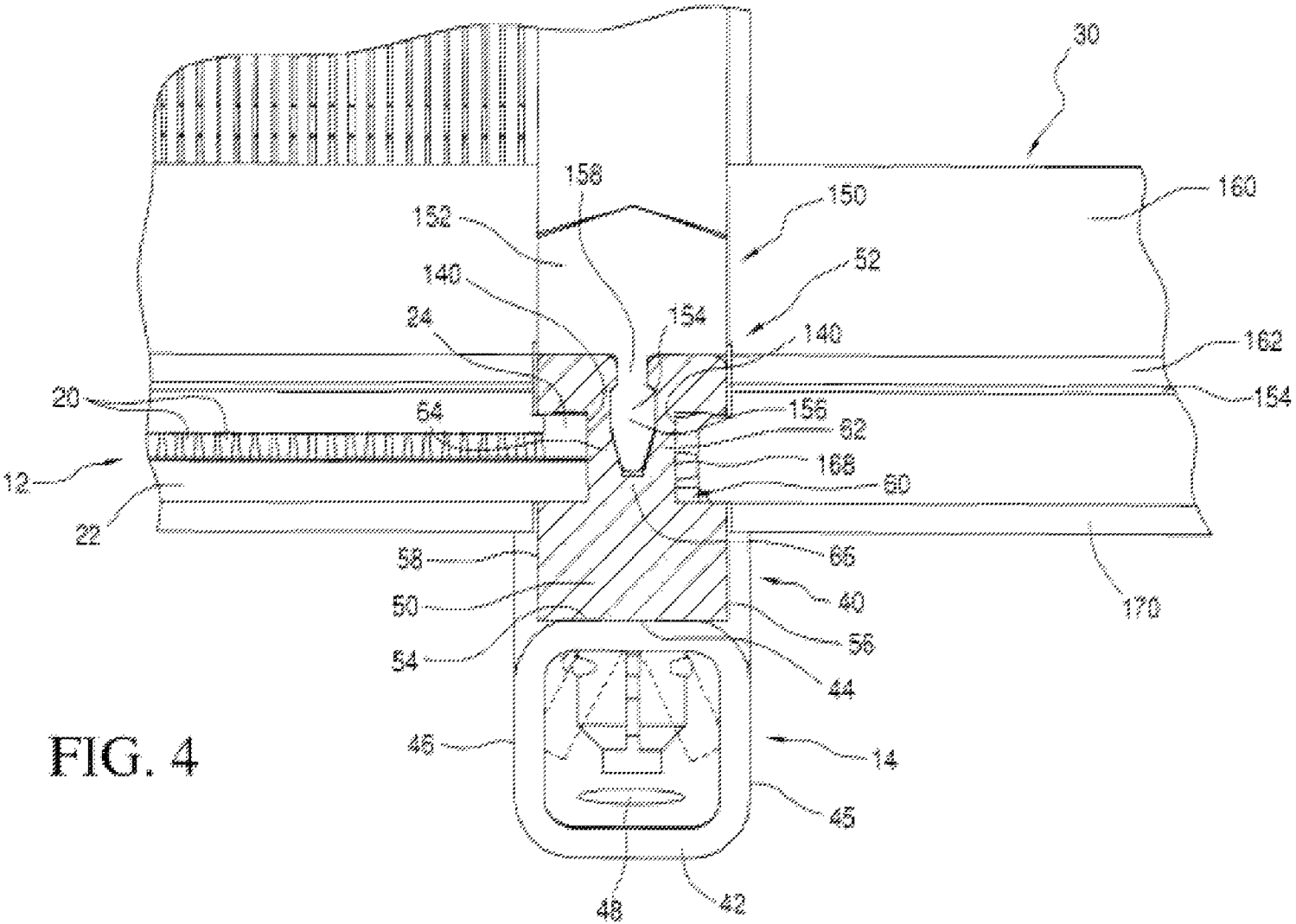
FIG. 4 is an enlarged end view of a portion of the vibrating separatory machine depicted in FIG. 3 and showing the assembly of the screen panel center retainer system in accordance with the present invention.

Referring again to FIG. 1, a vibrating separatory machine, such as the one depicted generally at 16, is utilized to separate a slurry into its components of solid and liquid. The slurry is caused to flow over the plurality of screen panels, generally at 12, which are structured, as is disclosed in greater detail in applicant's co-pending patent application Ser. No. 11/799,537, filed May 15,2007, now U.S. Pat. No. 7,717,269, issued May 18, 2010, the disclosure of which is expressly incorporated herein by reference. As may be seen in FIG. 4, each such screen panel 12 includes a plurality of generally parallel profile screen wires 20, typically of stainless steel and each somewhat trapezoidal in cross section. The screen wires 20 in each screen panel 12 extend parallel to the direction of material flow, as indicated by the arrow and legend in FIG. 1. Each screen panel 12 includes a plurality of transversely extending screen tie rods 22, only one of which is shown for the screen panel depicted in FIG. 4. Each screen panel 12 is further provided with parallel screen spacer bars 24, as is also depicted in FIG. 1 and 4: These screen spacer bars 24 are secured, by welding or the like, to the laterally extending ends of the screen tie rods 22, as is depicted in FIG. 4, and as is described in greater detail in the co-pending application Ser. No. 11/795,537, now U.S. Pat. No. 7,717,269, referenced above.

Figure 3:
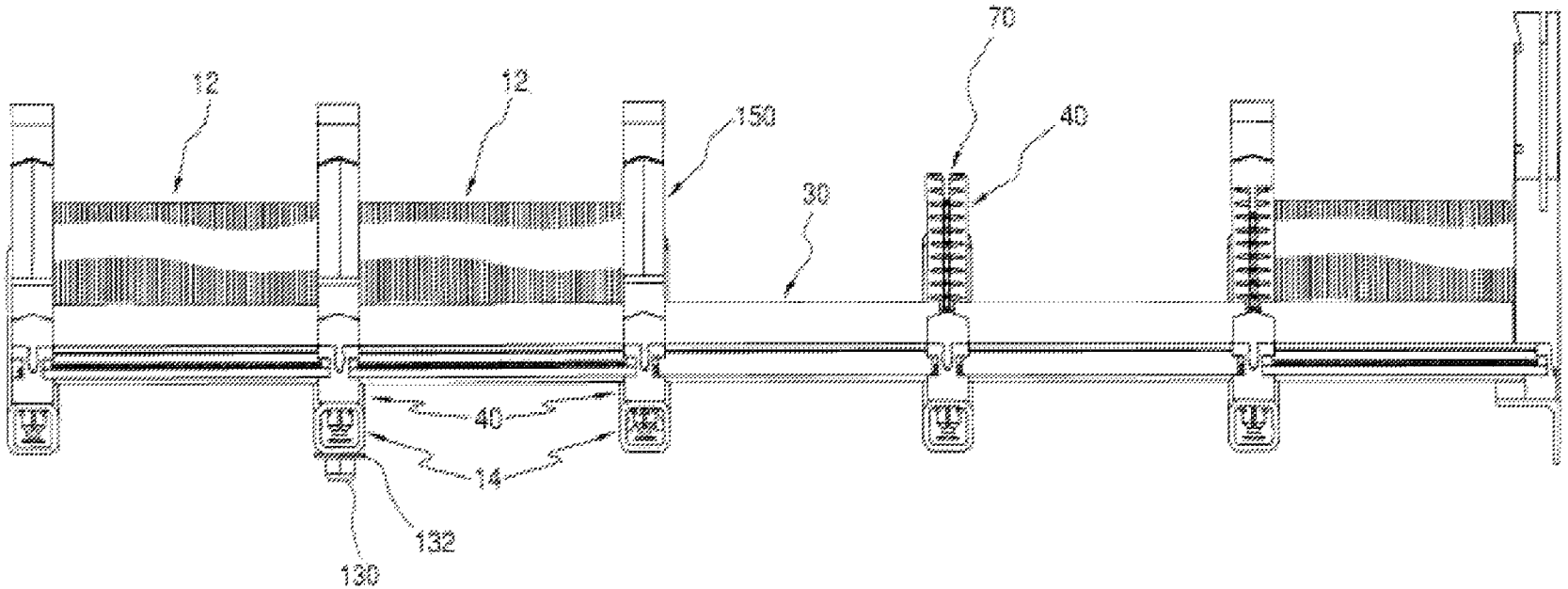
FIG. 3 is an end view of the vibrating separatory machine shown in FIG. 1 and showing the screen panel center retainer system installed.

The vibrating separatory machine, as depicted schematically in FIG. 1, supports a plurality of screen panels 12, each arranged with their profile screen wires 20, as seen in FIG. 4, extending in the direction of material flow. These screen panels 12 are subject to wear and require periodic replacement, with the amount of wear and the time between replacements being a function of the abrasiveness of the slurry being separated. In the machine 16 depicted in FIG. 1, and as may also be seen in FIG. 3 there may be provided inclined screen panels 12 in a first, inclined inlet or infeed section 26 of the machine 16. This first, inclined inlet or infeed section 26 is separated from a second, generally level section 28 of the vibrating separating machine 16 by art arrangement of transition dams, generally at 30, as seen in FIGS. 3 and 4. Each of these transition dams 30 serves to cover a transition between two serially arranged, somewhat relatively angled screen panels 12, in the flow direction. Each such transition dam 30 also acts to reduce the flow velocity of the slurry which is to be separated. As is depicted in FIG. 1, and as seen in greater detail in FIGS. 9 and 10, each transition dam 30 is held in place, at its ends, by a cross dam retainer, generally at 32. While each of these components will now be discussed in greater detail, the above will serve as an overview of the structure, function and operation of the screen panel center retainer system, generally at 10, in accordance with the present invention.

Figure 2:
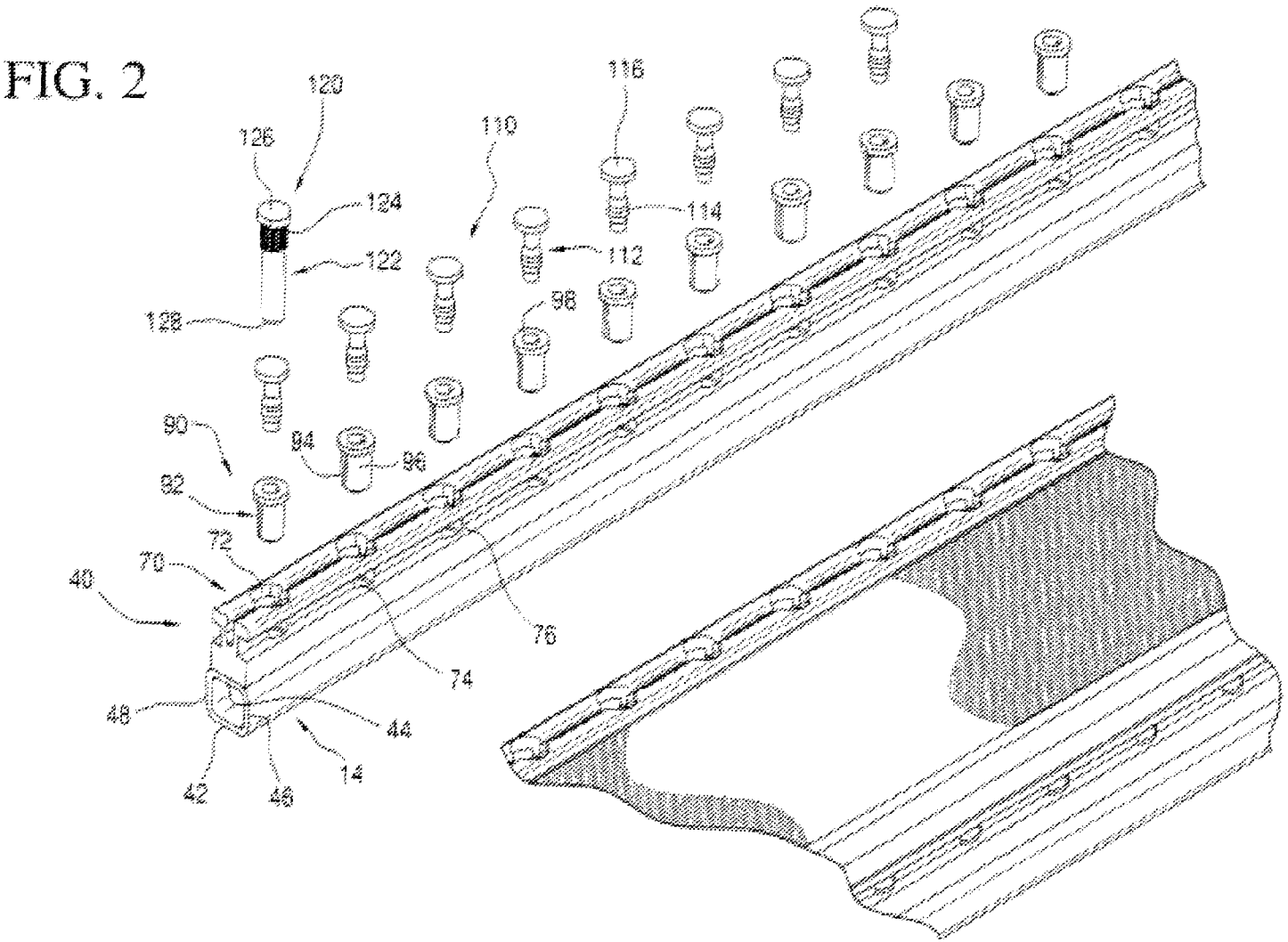
FIG. 2 is an enlarged portion of the exploded perspective view shown in FIG. 1 and showing the several components of the center retainer portion of the subject invention.
Figure 6:
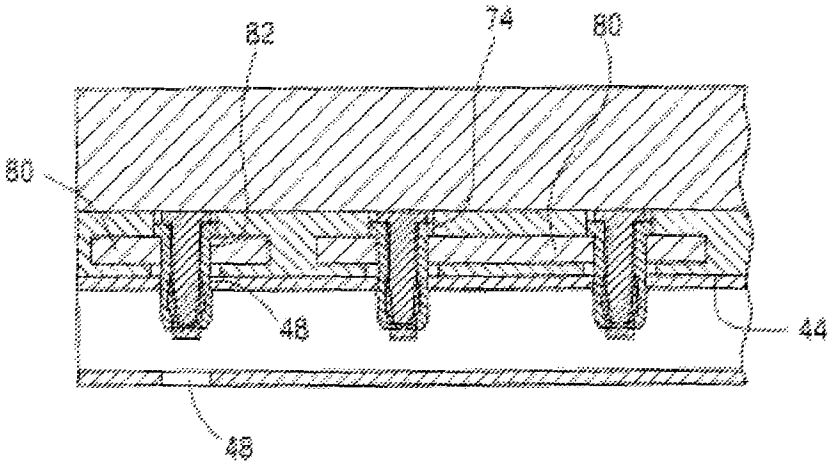
FIG. 6 is across-sectional view of the screen stringer rail, center retainer and locking strip and taken along line VI-VI of FIG. 5.
Figure 5:
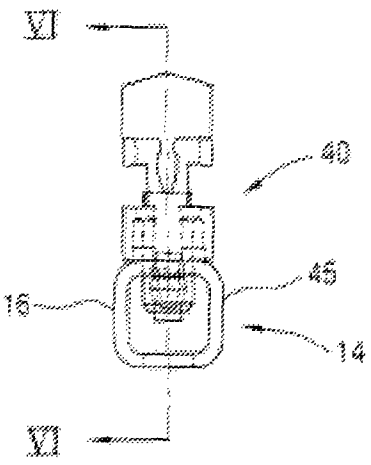
FIG. 5 is an end view of a screen stringer rail with a center retainer and locking strip in place.

Referring again to FIG. 1, and taken in conjunction with FIGS. 2 and 5, a first embodiment of a center retainer, generally at 40, is positionable atop each one of the screen stringer rails 14. As discussed above, each screen stringer rail 14 is depicted in FIGS. 1 and 6 as being a generally square hollow metal tube that includes a bottom surface 42, a top surface 44 and opposing side surfaces 45; 46. The top surface 44 and also possibly the bottom surface 44 of the screen stringer rail tube 14 are provided with a plurality of evenly spaced holes 48, only one of which is visible in FIG. 4 and which may also be seen in FIG. 6. The holes 48 in the top surface 44 and in the bottom surface 42 of the screen stringer rails 14, are aligned with each other and are intended to be used to secure the center retainer, generally at 40, to the upper surface 44 of the screen stringer rail 14.

The center retainer, generally at 40, is typically formed of an ultra high molecular weight polyurethane or a similar strong, inert, durable and resilient material. It is provided with spaced metal stiffener bars as seen in FIG. 6, and as will be discussed in detail subsequently. As may be seen most clearly in FIGS. 2 and 4, the center retainer, generally at 40 is a combination of a center retainer base 50 and a screen panel edge retainer 52. The center retainer base 50 is preferably generally rectangular in cross-section, as may be seen most clearly in FIG. 4 and has a base bottom 54, base sides 56; 58 and a center retainer base upper portion 60. The screen panel edge retainer channel portion 52 of the center retainer, generally at 40, is, as seen in FIG. 4, generally V-shaped in cross-section and includes a pair of upwardly opening legs 62 and 64. These legs 62, 64 diverge upwardly and outwardly from a central channel apex 66 which is integrally formed with the center retainer base 50 and which is located at the base upper portion 60. The function of these legs 62 and 64 will be discussed in greater detail subsequently.

Turning again to FIG. 1, and now taken in conjunction with FIG. 2, the first embodiment of the center retainer, generally at 40, is provided with a plurality of equidistantly spaced through bores, generally at 70. Each such through bore, generally at 70 includes a first, upper bore section 72 with a first diameter and a second, lower bore section 74. The first, upper-bore section 72 of each through bore 70 is formed equally in both of the legs 62 and 64 of the screen panel-edge retainer, generally at 52. The lower bore section 74 is formed in the center retainer base 50. Each such through bore 70 passes through the apex which forms the juncture between the screen panel edge retainer 52 and the base 50 of the center retainer 40. Apertures 76 may be formed in the upwardly opening legs 62, 64 of the center retainer base upper portion by the formation of the upper bore, sections 72, As may be seen most clearly in FIG. 6, the center retainer base 50 includes a plurality of spaced metal or similar rigid material reinforcement strips, generally at 80. These reinforcement strips 80 are incorporated into the base 50 of the center retainer 40 during its fabrication. Each of the second, lower bore sections 74 of the center retainer 40 includes a lower bore section reduced diameter portion 82. As may be seen in FIG. 6, this reduced diameter portion 82 is formed in ones of the reinforcement strips 80. The purpose of these bores 70 in the center retainers 40 will now be discussed.

The through bores, generally at 70 are spaced at 4 inch centers and are usable to secure the center retainer, generally at 40 to the screen stringer rail 14 on which each center retainer 40 is placed. It will be understood that the through bores 70 in the center retainer 40 are spaced the same as, and thus will overlie, the holes 48 which are preferably located in both the top surface 44 and the bottom surface 42 of the screen stringer rails 14.

Each of the through bores 70 in the center retainer 40 is sized to receive a cooperatively sized expansion sleeve, generally at 90. One such expansion sleeve is shown most clearly in FIG. 7. Each such expansion sleeve 90 has a cylindrical expansion sleeve body 92, which is defined by bifurcating sleeve body walls 94 and 96. An expansion sleeve upper flange 98 sits atop the cylindrical expansion sleeve body 92 and joins the tops of the two bifurcating sleeve body walls 94 and 96. The expansion sleeves 90 are each sized such that they will pass downwardly through the first, upper bore section 72 of each through bore 70 in the center retainer. The expansions sleeve body 92 will pass through the second, lower section 74 of each associated center retainer through bore 70. The expansion sleeve body 92 will also pass down through the lower bore reduced diameter section 82 formed in the associated reinforcement strip 80. The expansion sleeve upper flange 98 will be received on an upper surface of each of the reinforcement strips 80 because the diameter of the expansion sleeve upper flange 98 is greater than that of the lower bore section reduced diameter portion 82. As may be seen most clearly in FIGS. 4 and 7, each expansion sleeve bifurcating sleeve body wall 94 and 98 is provided with an exterior rib 100 intermediate its distal end and the sleeve flange 98. These ribs 100 will underlie the top surface 44 of the screen stringer rail 14 after the expansion sleeve 90 has been pushed down into the center retainer through bore 70 to the depth that the expansion sleeve upper flange 98 is in engagement with the upper surface of it is associated reinforcement strip 80. The purpose of these exterior sleeve ribs 100 is to hold the center retainer 40 to the screen stringer rail 14 before the center retainer 40 is positively secured to the screen stringer tubes 14.

Figure 7:
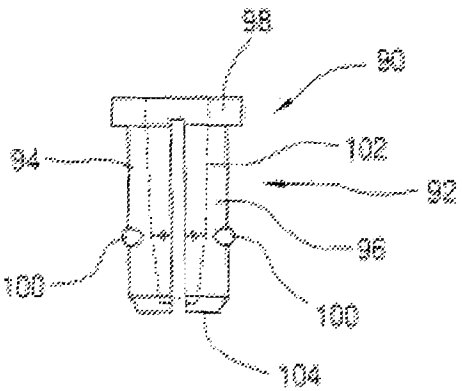
FIG. 7 is a side elevation view of an expansion sleeve in accordance with the present invention.

As may also be seen in FIG. 7, each expansion sleeve body 90 includes an interior, reducing diameter tapered bore, generally at 102. The interior, reducing diameter tapered bore 102 decreases in diameter as it approaches a distal end 104 of each expansion sleeve body 92. In a preferred embodiment, the taper of this inferior diameter 102 of the expansions sleeve body 92 is the range of between 3° and 7° with the degree of taper preferably increasing toward the expansions sleeve body distal end 104.

Referring again presently to FIGS. 2 and 6, each expansion sleeve 90 is used in conjunction with a cooperatively shaped expansion pin 110. Each such expansion pin has a pin shank 112 which is provided with a central, enlarged protuberance 114. Each expansion pin 110 also has an expansion pin head 116. As may be seen in FIG. 6, and even more clearly in FIG. 4, the insertion of each expansion pin 110 into its cooperating one of the expansion sleeves 90 will act to expand the bifurcated sleeve body walls outwardly. This is due to the cooperative effort of the expansion pin shank protuberance 114 and the interior reducing diameter tapered bore 102 of each sleeve 90. The bifurcation of the sleeve body walls 94 and 96, in response to the insertion of me expansion pin 110 into its respective expansion sleeve 90 is depicted most clearly in FIG. 4.

It will be understood that the securement of the center retainer 40 to the associated screen stringer rail 14, by the use of the cooperating expansion sleeves 90 and expansion pins 110 is particularly effective where the screen stringer tube 14 either does not have the lower holes 48, as depicted in FIG. 4, or if some of these lower holes 48 are obstructed, such as by the weldment or other attachment of the screen stringer tubes 14 to underlying angle iron or channel iron frame sections, not specifically shown, of the vibrating separatory machine. The securement of the center retainer 40 to its associated screen stringer rail 14 usually requires an expansion sleeve 90 and an associated expansion pin 110 to be placed in each of the through bores 70.

An alternative securement procedure for attachment of the center retainers 40 to their associated screen stringer rails 14 is through the use of suitable bolts and nuts, as is also illustrated in FIGS. 1 and 2. This mode of attachment is best used if the lower holes 48 in the screen stringer rails 14 are unobstructed.

As seen in FIGS. 1 and 2, there may be provided elongated spline bolts 120 in place of the expansion sleeves 90 and cooperating expansion pins 110. Each such spline bolt 120 has a bolt shank 122 that is provided with a splined portion 124 which underlies a spline bolt head 126. The diameter of the spline bolt shank 122 is sized so that it will pass through the bores 82 in the reinforcement strips 80 of the center retainers 40. The splines 124 form an interference fit with that bore 82. The head 126 of the spline bolt 120 is essentially the same, in diameter, as is the flange 98 on each expansion sleeve 90. The shank 122 of each such spline bolt 120 is of sufficient length that a distal end thereof 128, will extend for a sufficient distance below the bottom surface 42 of the screen stringer rail 14 so that it can receive a securement nut and lock washer, generally at 130 and 132, respectively, as seen in FIG. 1. If this mode of securement of the center retainer 40 to its underlying screen stringer rail is available, it is appropriate to place the spline bolts 120 on 12-inch spacings, as opposed to the 4-inch spacings used by the expansion sleeves 90 and their cooperating expansion pins 110. Either mode of securement of the center retainers 40 to their underlying screen stringer rails 14 is secure yet allows removal of the center retainer 40 in the unlikely event of breakage or undue wear of a particular one of the center retainers 40.

Each center retainer 40 is essentially universal in its adaptability to the various vibrating separatory machines with which the screen panel center retainer system, in accordance with the present invention, can be used. As discussed above, the center retainer 40 can be secured to an underlying screen stringer rail 14 through the use of expansion sleeves 90 and expansion pins 110, as depicted in FIG. 1; by the use of nuts and bolts as is also illustrated in FIGS. 1 and 2; or by the use of elongated spline bolts 120 and cooperating nuts 130 and lock washers 132. The universality of the first embodiment 40 of the center retainer of the panel section, and of a second embodiment, which will be discussed in detail subsequently, insures that the screen panel center retainer system of the present invention is truly universal in its application and can accommodate different replacement conditions that may be encountered during the process of retrofitting an existing vibrating separatory machine for use with the subject invention. The specific ones of the various attachment applications, as determined in the field, is usable with the center retainer 70, as it is supplied by the manufacturer. No special or custom fit parts are required.

Referring again to FIG. 4, and as has been discussed above, and as is further described in application Ser. No. 11/798,537, now U.S. Pat. No. 7,717,269, issued May 18, 2010, each screen panel 12 includes transverse tie rods 22 and elongated screen spacer bars 24. The ends of the tie rods 22 and the overlying screen spacer bars 24 form screen panel edges, as may be seen in FIG. 1. Each of the center retainer channel legs 62 and 64 is formed, as may be seen most clearly in FIG. 4 with an exterior screen panel edge receiving slot 140. Each such screen panel edge receiving slot 140 extends the length of its associated center retainer channel leg. It is to be noted at this juncture that only one screen panel 12 is shown in FIG. 4 and is located in engagement with the left center retainer channel leg 64. The right center retainer channel leg 62 is depicted, in FIG. 4, as receiving one end of a transitional dam, generally at 30, as will be discussed in detail shortly. The screen panel edge receiving slot 140 in the exterior surface of each of the center retainer channel legs 62, 64 is dimensioned to closely engage an associated screen panel edge, constituted by the spaced ends of the tie rods 22 and the overlying, elongated screen spacer bar 24. Since the center retainer channel legs 62 and 64 are somewhat resilient, they will form a generally leak-resistant connection to the respective screen panel edge. Very little, if any, of the separated slurry will become lodged under the tie rod ends.

Each center retainer 40 is paired with a cooperatively shaped locking strip, generally at 150. As may be seen in FIG. 1, each locking strip 150, in a first preferred embodiment, is slightly shorter in length than is the associated one of the center retainer 40. This is done to provide installation space for the cross dam retainer 32 as will be discussed shortly. As is seen more clearly in FIG. 4, each locking strip, generally at 150, is somewhat T-shaped in cross-section. It includes a locking strip top 152 and a locking strip wedge tongue 154. The locking strip wedge tongue 154 is dimensioned to be cooperatively received in the center retainer upper portion 60 of the center retainer 40 and to force the two channel legs 62 and 64 to flex outwardly. Such outward flexation of the channel legs 62 and 64 is sufficient to insure a firm sealing of the screen panel edges in their associated receiving slots 140 situated on the exterior surfaces of the channel legs 62 and 64. The locking strip wedge tongue 154 includes an enlarged distal expander barb 156 and a reduced width connection web 158 which joins the expander barb 156 to the locking strip top 152. This structure, and the complementary shape of the center retainer channel 60 which is defined by the space between the inner walls of the two channel legs 62 and 64, will retain the locking strip 150 firmly in place in the center retainer 40, once it has been installed. While the barbed end 156 of the locking strip wedging tongue 154 is intended to be removable from between the center retainer channel legs 62 and 64, such a removal requires the exertion of a sufficient amount of force that the locking strip 150 and the center retainer 40 will not be unintentionally separated.

Figure 12:
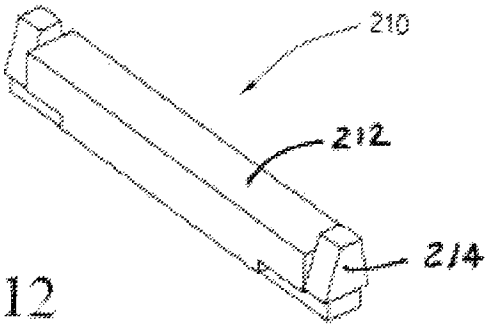
FIG. 12 is a perspective view of a non-transitional dam usable in the present invention.

A plurality of transverse dams are typically utilized in vibrating separating machines such as the ones depicted in FIG. 1 and also in FIG. 12. These dams, such as the transitional dams, not all of which are indicated generally at 30 in FIG. 1, extend across the bed of the vibrating separatory machine and are intended to control the rate of flow of the slurry to be separated, as it enters onto the bed of the machine, as defined by the screen panels 16 and as it flows over the screen panels 16. As may be seen in FIG. 1, the inlet end of the vibrating separatory machine, which is the end to the right, as depicted in FIG. 1, is inclined. A plurality of transitional ones of the dams, generally at 30, are located at the juncture of the inclined inlet section of the vibrating separatory machine with the typically longer, generally horizontal main portion of the machine bed, not all of which is depicted in FIG. 1. These transitional dams 30, as well as other dams, also 30, and that may also be located along the length and width of the main bed of the vibrating separating machine, and which are depicted in FIG. 12, are held in place by the cross dam retainers 32, as will now be discussed in detail.

Figure 8:
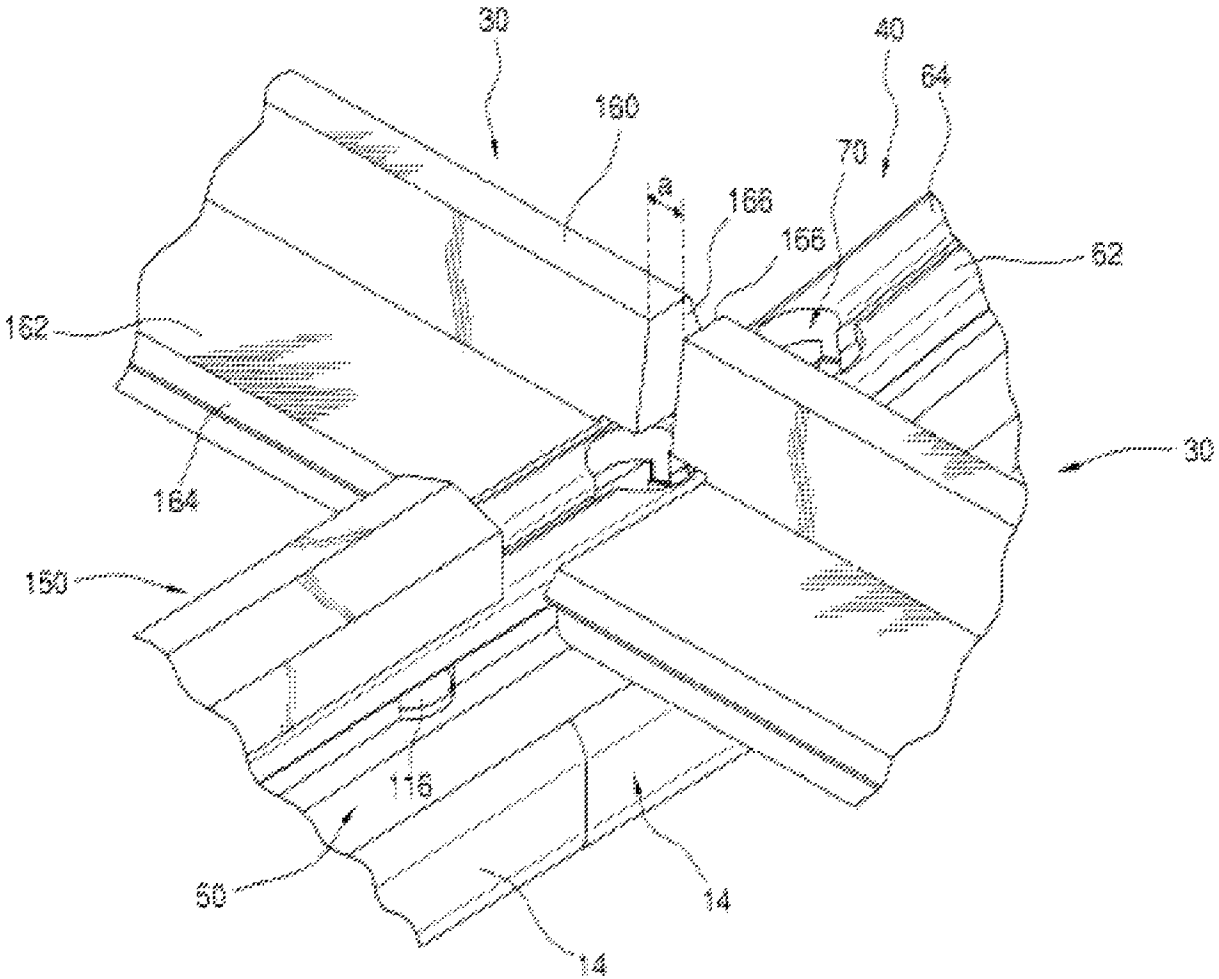
FIG. 8 is an enlarged perspective view of an encircled portion, shown in FIG. 1, of the juncture of two adjacent dams and their cooperating center retainers in accordance with the present invention but without across dam retainer in place.

Referring now to FIG. 8, there may be seen a junction point of a pair of transitional dams 30, a pair of center retainers 40 and one locking strip 150, all in accordance with the present invention. For the sake of ease of illustration, the screen panels have been omitted from this depiction. A pair of underlying screen stringer rails 14 are overlaid by one or two of the center retainers 40, as described previously. One of the expansion pin heads 116 can be seen in one of the through bores 70 in the center retainer 40. One locking strip 150 is shown in place whereas a second locking strip and the cross dam retainer 32 are missing from FIG. 8.

Figure 9:
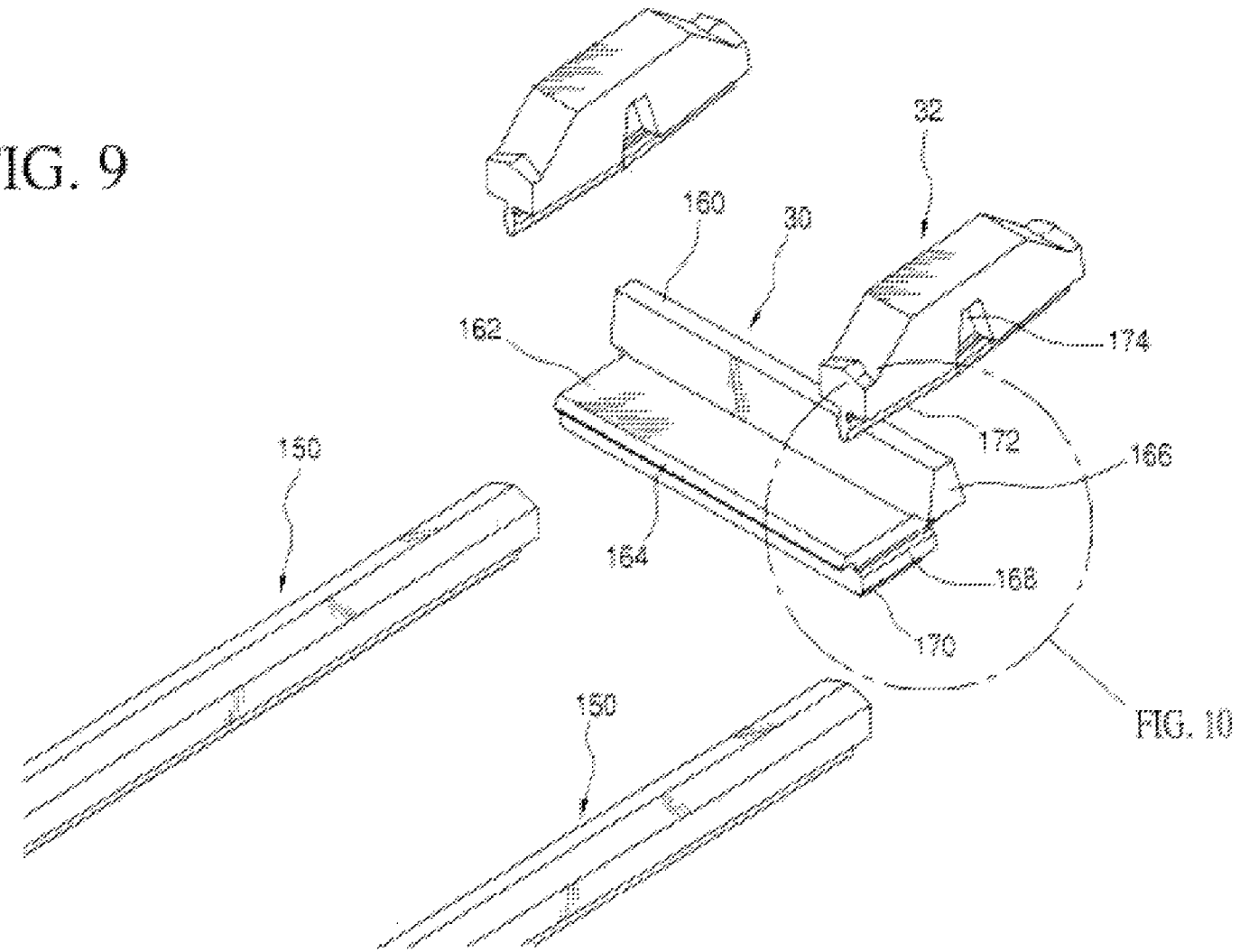
FIG. 9 is an enlarged perspective view of a portion of the screen panel center retainer system depicted in FIG. 1, and showing the cooperation of cross dam retainers and a transitional dam, all in accordance with the present invention.

As may be seen in FIG. 8, and as is also shown in FIG. 9, each transitional dam, generally at 30, includes an upstanding dam wall 160 which is generally trapeziodal in cross-section. Each such dam wall 160 is positioned atop, and is formed integrally with a dam body 162 that is generally planar and is somewhat rectangular in cross-section. A dam body lip 164 is formed on the downstream edges of the dam body 162 and will overlie a screen panel. An undersurface of the dam wall 160 and of the dam body lip 164 can be provided with a layer of resilient foam to insure a leak-resistant seal between the dam and the trailing and leading edges of the sequentially arranged screen panels; respectively. Each dam is made of a durable, resilient material which will wear well but which will not damage the solid particles in the slurry to be separated.

Each dam wall 160 is provided with dam wall ends 166 which extend beyond the sides of the dam body 162. These dam wall ends 166 will overlie the legs 62 and 64 of the center retainer 40 when the dams 30 are properly positioned above the screen panels 12. As may be seen in the right side of FIG. 4, and as was mentioned briefly previously, the dam 30 is retained in place by each center retainer 40 generally in the same manner as are the screen panels 12. Each dam body 162 includes a dam retainer lip, generally at 168, which dam retainer lip, as seen in FIG. 4, is sized to fit into the screen panel edge retainer slot 140 of its associated one of the center retainer channel legs 62 or 64. Each transitional dam 30 also is provided with a lower support lip 170 that will abut the respective center retainer base side wail 56 or 58 to provide additional stability when the transitional dams 30 are installed.

Figure 10:
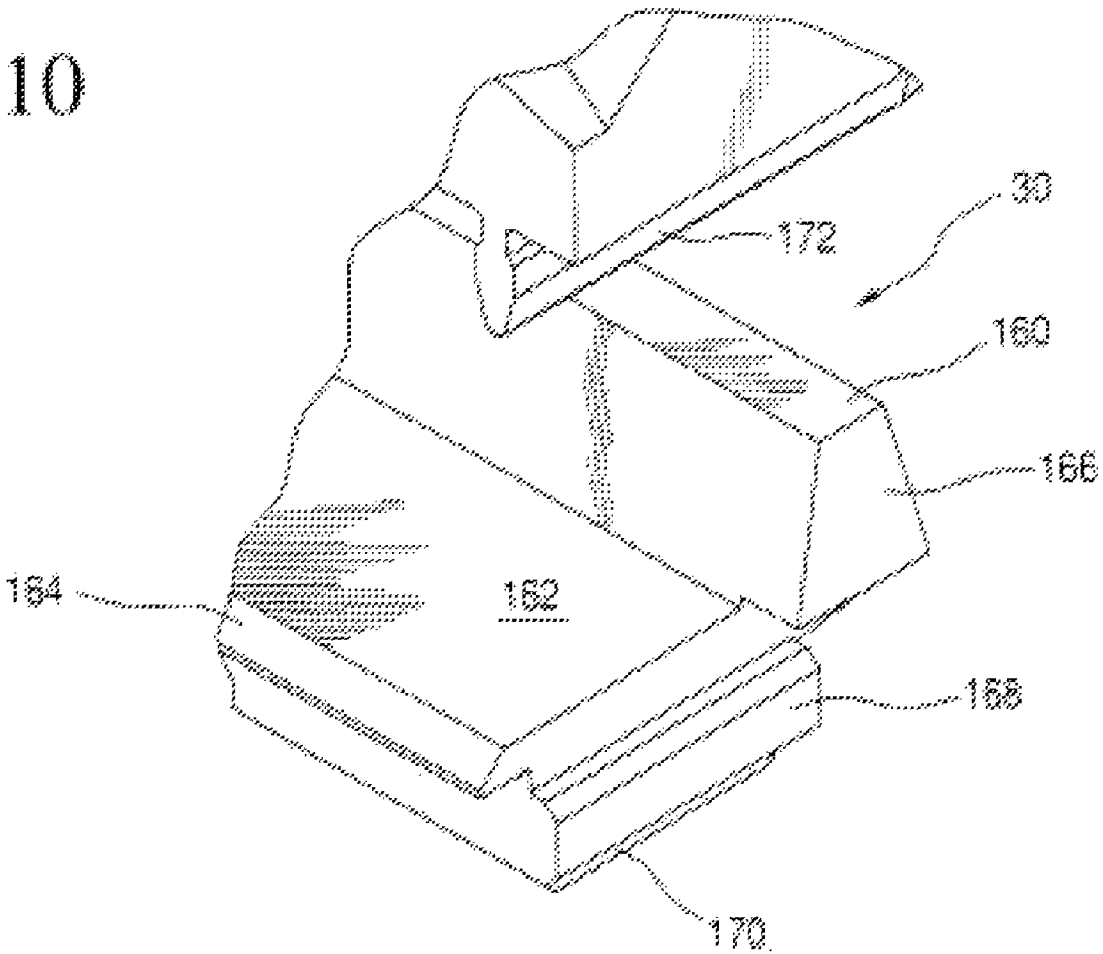
FIG. 10 is an enlarged perspective view of an encircled portion, shown in FIG. 1 and also shown in FIG. 9, of the cooperative shapes of a transitional dam and of a cross-dam retainer.

As may be seen most clearly in FIG. 9, and also in the enlarged portion thereof, which is shown in FIG. 10, each cross dam retainer, generally at 32 is, as its name implies, a retainer that crosses over an end of an associated dam 30 and holds that end of its associated dam 30 in place. Each cross dam retainer 32 has a lower locking strip tongue 172 whose structure is the same as the locking strip tongue 154 of each of the locking strips, generally at 150. Each cross dam retainer 32 has an overall outer shape that is similar to the shape of the locking strip top 152 so that each cross dam retainer will form a smooth transition between the two locking strip tops 152 with which it cooperates. As may be seen most clearly in FIG. 9, each cross dam retainer 32 has a transverse body cutout 174 or keyway that is sized to receive the dam wall ends 166 of two adjacent transitional dams 130. The ends 166 of the dam wall 160 will be slid into the cross dam retainer transverse body cut out or keyway 174 as the cross dam retainer 32 is lowered into place. It is to be understood that the two adjacent dam wall ends 166 are not in abutting engagement, as may be seen in FIG. 8. Instead, they are spaced apart at a spacing distance "a" which is just slightly greater than a corresponding width of the cross dam retainer locking strip tongue 172.

A non-transitional dam is shown generally at 210 in FIG. 12. This non-transitional dam 210 will typically be used between longitudinally adjacent screen panels 16 in the generally planar section of the vibrating separatory machine, as depicted generally in FIG. 1. Each of the non-transitional dams 210 is generally similar to a counterpart transitional dam 30 in its overall function. The primary difference is that the non-transitional dams 210 do not require the elongated dam body 162 and dam body lip 164 of the transitional dam 30.

Figure 13:
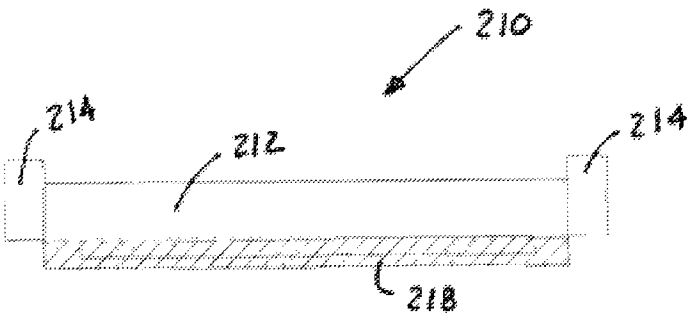
FIG. 13 is a side elevation view of an embodiment of the dam depicted in FIG. 12.
Figure 14:
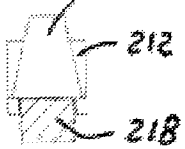
FIG. 14 is an end view of the dam depicted in FIG. 13.

The non-transitional dam, generally at 210, as depicted at FIG. 12, is structured having a generally rectangular dam body 212. Each end of the dam body 212 is formed with an integral dam body key 214. As may be seen, each such dam body key 214 is generally in the form of a trapezoid whose overall shape is complementary to the shape of a complementary transverse body cut out or keyway 174 that is provided in the first embodiment of the dam retainer 32 depicted most clearly in FIG. 9. Each such dam 210 may be provided with an underlying flexible foam rubber seal 218, as depicted in FIGS. 13 and 14.

Figure 17:
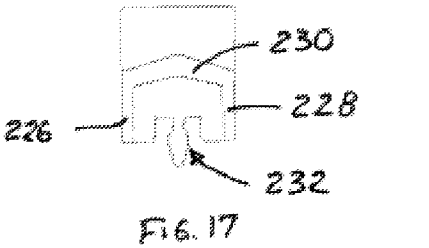
FIG. 17 is an end view of the dam retainer of FIG. 16.
Figure 16:
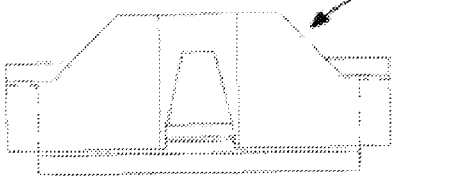
FIG. 16 is a side elevation view of the second embodiment of the dam retainer depicted in FIG. 15.
Figure 15:
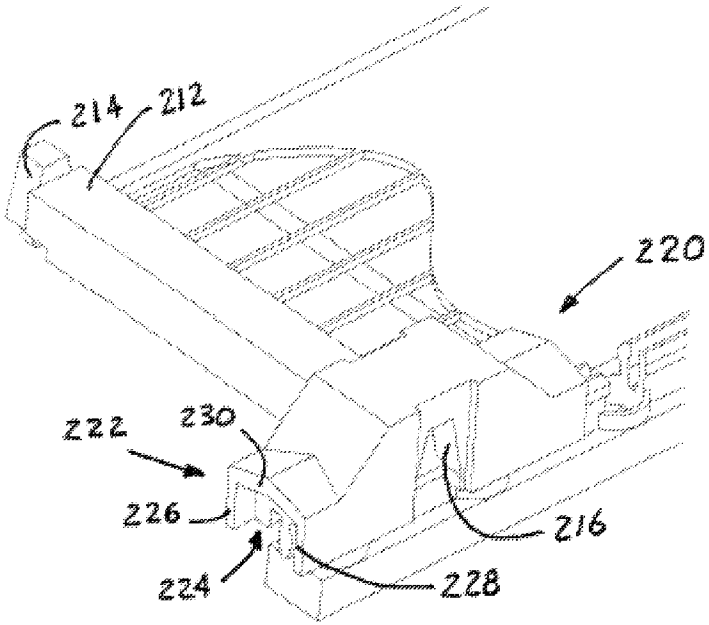
FIG. 15 is a perspective view of a second preferred embodiment of a dam retainer in accordance with the present invention and depicted in its installed position.

A second embodiment of a dam retainer, generally at 220, is depicted in FIGS. 15-17. While its overall structure and function is generally similar to that of the first preferred embodiment of the dam retainer 32 of FIG. 9, this second preferred embodiment 220 has one significant difference, as will now be discussed.

The locking strips, generally at 150, as seen in FIGS. 1 and 9, for example, are typically approximately 48 inches in length. Each such locking strip is made of a polyurethane material which typically has a Coefficient of Thermal Expansion or (CTE) of approximately 88 millionths of an inch, per inch, per degree F. Vibrating separatory machines, such as the ones in which the present screen panel retainer system finds use, are intended to be used in a temperature range of generally 32° F to 100° F. Over such a temperature range, the change in length of a 48-inch locking strip 150 can be as much as 0.295 inch. This is almost 5/16 of an inch. Such a change in length can result in gaps for the slurry to pass through unscreened or can make it difficult to insert the locking strips 150 between spaced ones of the dam retainers. A common screen opening or separatory size for a screen panel used in a vibrating separatory machine can be as small as 1/32 of an inch. A change in length of 5/8 of an inch for one of the locking strips 150 can create gaps that will allow the passage of unseparated slurry.

As may be seen, for example, in FIG. 9, an end face of the first embodiment of the dam retainer 32 is planar. It cooperates with a similar planar end face of a locking strip 150. In the assembled device depicted in FIG. 1, the locking strip 150 is shown as being in an abutting relationship with its associated dam retainers 32. Such an abutting relationship has been found, in practice, to be difficult to attain with great accuracy due to manufacturing tolerances and to the variations in the length of the locking strips 150 encountered as a result of fluctuations in operating environment fluctuating temperatures. As a result the locking strip 150 is prone to deform, if its length is greater than the spacing between the two dam retainers 32 with which it is associated, or to gap at the dam retainers 21 if its length is less than the spacing between the two associated dam retainers 32.

In accordance with the second preferred embodiment of the dam retainers, generally at 220, in accordance with the present invention, each dam retainer 220 is provided, at both of its end faces, with an overlying or overhanging lip, generally at 222. This overlying or overhanging lip 222 defines a locking strip end receiving pocket 224 whose shape is complementary to the cross-sectional shape of the associated locking strip 150 whose end will be received in the pocket 224. Each such pocket 224 has a pocket depth of approximately 0.625 inch. This is sufficient to allow the associated locking strip 150 to undergo temperature related extension and contraction while insuring that the end of the locking strip 150 will always reside in the pocket 224 of the dam retainer 220, at least during anticipated changes in operating temperature of the vibrating separatory machine. The inner wall cross-sectional configuration of the dam retainer end pocket 224 will be complementary to the cross-sectional configuration of the locking strip 150. This will insure a snug fit of the ends of the locking strip 150 in the dam retainer pocket 224 without bending or interference. The locking strip 150 thus will cooperate with the overlying or overhanging lip 222 of the dam retainer 220 to prevent the seepage of any of the slurry to be separated through a gap that might otherwise exist.

As may be seen in FIG. 15, for example, the overlying or overhanging lip 222 has two vertical lip walls 226 and 228 and an arched lip top 230. The dam retainer 220, as depicted in FIGS. 15-17, also has a lower locking strip tongue 232 that is the same, in shape, as the locking strip tongue 154 of the locking strip depicted, for example, in FIG. 4. The dam retainer keyway 216 will be understood as having the appropriate trapezoidal shape so that the dam key 214 located at either end of the dam 212 will be firmly secured and retained in the keyway 216.

In the first preferred embodiment of the center retainer 40 shown in FIG. 2, for example, a plurality of apertures 76 were formed in the upwardly opening legs 62 and 64 of the central retainer upper portion 60. Turning now to FIGS. 18-20, in a second preferred embodiment of the present invention, the center retainer 240 is again configured haying a center retainer bass 242, that is generally rectangular in cross-section, and a pair of bifurcating center retainer opening legs 244 and 246. A plurality of center retainer bores 250 are again spaced along the length of the center retainer 240 and function in the same manner as do the bores 70 described in connection with the first embodiment of the center retainer 40, as shown in FIG. 1.

In the second preferred embodiment of the center retainer 240, each center retainer bore 250 is bordered by a pair of arcuate, upstanding bore encircling lips or rings 252, 254. In the first preferred embodiment, it has been determined that the apertures 76 formed in the upstanding legs 62 and 64 are potential sites of slurry leakage. This is also a function of the structure of the locking strip top 152 of the locking strip 150, as depicted in FIG. 4. In that first embodiment, the top 152 of the locking strip 150 has a generally planar lower surface. That lower surface sits atop the upper ends of the opening legs 62 and 64. The result is the possible leakage of unseparated slurry through the apertures 76.

As may be seen in FIGS. 21 and 22, a second preferred embodiment of the locking strip 260 includes a locking strip top 262 that has a pair of downwardly depending locking strip top sealing flanges 264; 266. These flanges 264; 266 cooperate with the center retainer bore encirculating lips or rings 252 and 254 to form a much better seal between the locking strip 260 and the center retainer 240 when the locking strip 260 is positioned, with its enlarged distal expansion barb 268 secured between the legs 244 and 246.

Figure 11:
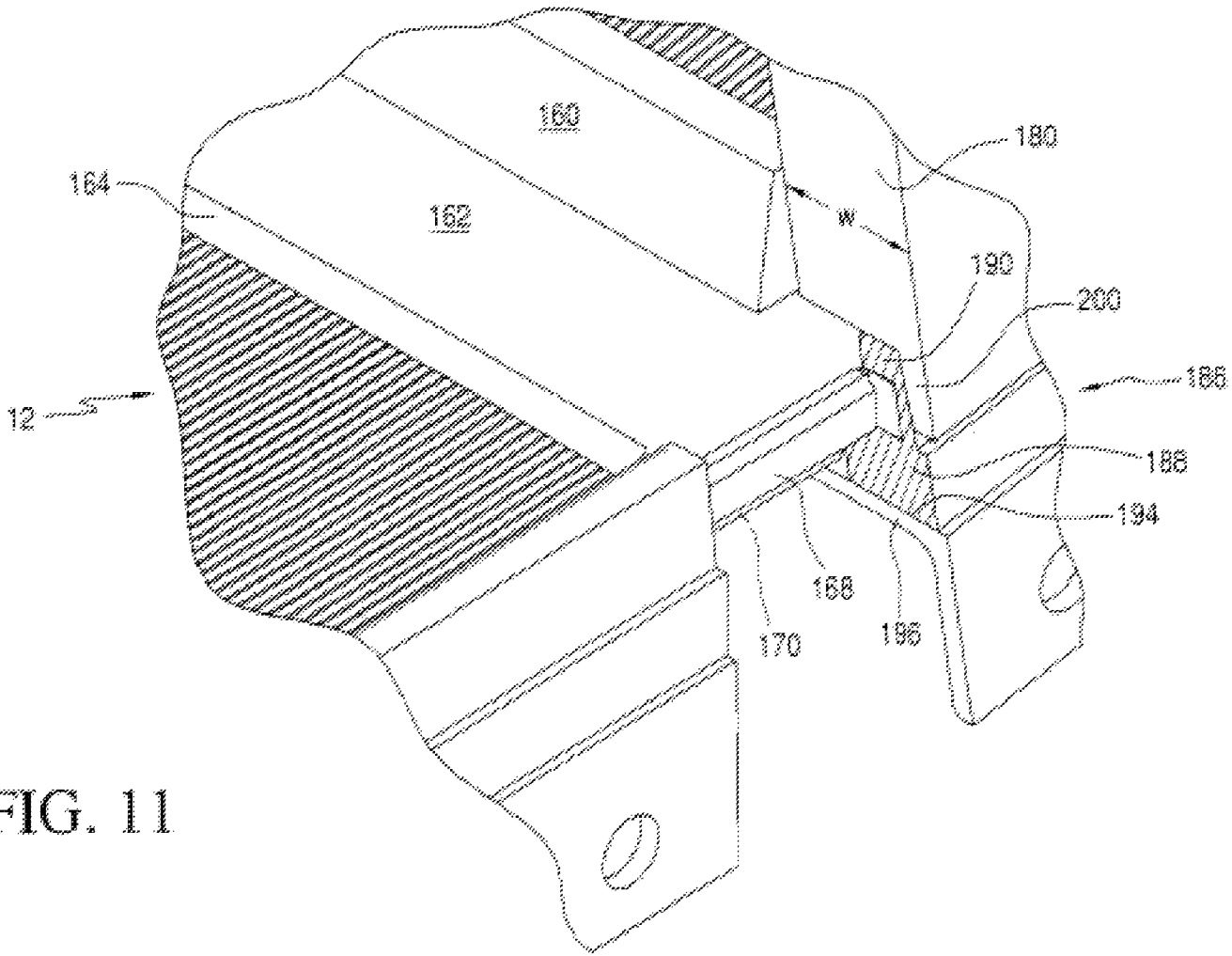
FIG. 11 is a perspective view of an enlarged portion, shown encircled in FIG. 1, of a right hand side transitional dam and its cooperation with a screen panel support standoff and with a side board holddown.

The bed of the vibrating separatory machine which is depicted somewhat schematically in FIG. 1, is defined by lateral side boards, one of which is shown at 180 in FIG. 1, and is also seen in somewhat more detail in FIG. 11. Each of these side boards 180 is adapted to be removably attached to side walls of the vibrating separating machine, in a manner that is well known in the art. Reference may be had to the previously mentioned Henry U.S. Pat. Nos. 5,112,475, and 5,277,319, the disclosures of both of which are expressly incorporated herein by reference, for a more detailed depiction of the securement of a side board 180 side wall of a vibrating separatory machine. Each of these sideboards 180 is typically fabricated of an ultra high molecular weight polyethylene.

As is depicted in FIG. 11, there is shown a right side one of the transitional dams generally at 30. This right side transitional dam 30 is similar to the several other dams 30 with the exception that the dam wall 160 is foreshortened by the elimination of the dam wall end 166. Since this is a right side dam, it is the right-side dam wall end 166 that has been foreshortened. It will be apparent that there will be a mirror image left side dam 30 in which the left dam wall end is foreshortened. In either the right side or the left side dam, the amount of foreshortening of the dam wall 160 will be a function of the thickness or width "w" of the side board 180, as seen in FIG. 11.

As may also be seen in FIG. 11, the dam retainer lip 168 and while not specifically depicted, the screen panel edge, will be supported by a screen support standoff, generally at 186. Each such screen support standoff 186 is effectively one-half of a center retainer 40 which center retainer 40 has, in effect, been cut in half along a longitudinal axis extending in the material flow direction. The screen support standoff 186 thus has a generally rectangular lower body 188 whose width is half that of the center retainer 40. The screen support standoff 186 also includes one of the retainer channel legs, here leg 190, which retainer channel leg 190 or more accurately screen support standoff leg 190 includes a screen panel edge receiving slot 192 that is the same in both shape and function as the screen panel edge receiving slot 140 in either of the retainer channel legs 62, 64.

The lower body 188 of the screen support standoff 186, is supported, along its lower surface 194, by a flange 196 of a lower machine frame channel 198. The side board 180 has a depending side board holddown 200 which is engageable with what would otherwise be an interior wall surface of the retainer channel leg 190 of the screen support standoff. It will be understood that, while not specifically depicted, the left side of the vibrating separating machine, which is not depicted in FIG. 1. would be the mirror image of the right side, as described above and as depicted in FIGS. 1 and 11.

The screen panel center retainer system in accordance with the present invention is universal in its applicability to the various commercially available vibrating separatory machines. Attachment of the center retainers to the screen stringer rails is easily and quickly accomplished using either the combination of expansion sleeves and expansion pins, the spline bolts, or a traditional bolt, washer and nut assembly. The hole spacings and sizing on the center retainer are complementary to that on the screen stringer rails of the several different vibrating separatory machines. The center retainers are no wider than are the screen stringer rails and thus do not take up otherwise usable screen space.

Insertion of the screen panels into the screen panel edge retaining slots is not difficult, does not require special tools and does not require the attachment of separate strips or fixtures to the screen panel edges. Insertion of the locking tongues of the locking strips into the retainer channels of the center retainer is able to be accomplished using a simple hammer or the like. Again, no special tools or complex fastening systems are required. The screen panel center retainer system of the subject invention is also usable with the cross dams that are found in such vibrating separating machines. Further, the side boards can be easily configured to work with screen support standoffs to duplicate one half of a center retainer and locking strip. In overall execution, the screen panel center retainer system of the subject invention is simpler, easier to use, less costly and results in more open screen surface than do the prior systems which it replaces. The dam retainers can be structured to compensate for dimensional changes of the locking strips and to thereby prevent leakage or passage of unseparated slurry.

While preferred embodiments of a screen panel center retainer system in accordance with the present invention have been set forth fully and completely hereinabove, it will be apparent to one of skill in the art that changes in the overall size of the vibrating separatory machines with which the system is to be used, the specific structure of the vibrating separatory machines, the specific shapes of the profile screen wires, and the like could be made without departing from the true spirit and scope of the present invention which is accordingly to be limited only by the appended claims.

What is claimed is:

1. A screen panel center retainer system for use in a vibrating separatory machine and comprising:

at least a first center retainer, said at least first center retainer including a center retainer base, said at least first center retainer extending in a flow direction of material being processed by said vibrating separatory machine;

a center retainer channel in said at least first center retainer and being defined by upwardly diverging first and second retainer channel legs;

a plurality of through bores in said center retainer, each said through bore passing through an apex defined by said first and second retainer channel legs and through said retainer channel base;

securement means passing through at least some of said plurality of through bores and being adapted to be engageable with a structural member of the vibrating separatory machine upon which said center retainer base lower surface is engageable;

a locking strip including a locking strip top and a locking strip wedging tongue depending from said locking strip top, said locking strip wedging tongue being receivable in said center retainer channel, said locking strip having a locking strip length extending in said material flow direction and further having spaced first and second locking strip ends;

at least one cross dam extending across said vibrating separatory machine transversely to said material flow direction;

at least one cross dam retainer, said at least one cross dam retainer having a cross dam retainer body with first and second cross dam retainer body ends spaced in said material flow direction;

a locking strip end receiving pocket in each said cross dam retainer body end, each said locking strip end receiving pocket being sized to receive one of said ends of one of said locking strips; and an overlying lip on each said cross dam retainer body end and defining said locking strip end receiving pocket in each said cross dam retainer body end.

2. The screen panel center retainer system of claim 1 wherein each said locking strip top has a defined cross-sectional shape and further wherein each said locking strip receiving pocket is complementary in shape to said locking strip top cross-sectional shape.

3. The screen panel retainer system of claim 1 wherein said length of each of said locking strips is a first length and wherein first and second ones of said cross dam retainers are spaced at a second length, said second length being greater than said first length, said locking strip ends being out of physical contact with said cross dam retainer ends.

4. The screen panel retainer system of claim 3 wherein each said locking strip has a coefficient of thermal expansion of approximately 88millionths of an inch/per inch/per degree F.

5. The screen panel retainer system of claim 1 wherein each overlying lip has a length of approximately ⅝ inch.

6. The screen panel retainer system of claim 1 wherein a spacing distance between one of said first and second ends of said locking strip and a cooperating one of said cross dam retainer body ends is less than a length of said overlying lip of said cooperating one of said cross dam retainers.

7. The screen panel retainer system of claim 1 wherein each said cross dam retainer has a cross dam retainer wedging tongue which is absent from said locking strip end receiving pocket in said cross dam retainer end.

* * * * *